United States Patent [19]

Diankui et al.

[11] Patent Number: 4,865,519

[45] Date of Patent: Sep. 12, 1989

[54] OIL SUBMERSIBLE PUMP

[75] Inventors: Liu Diankui; He Benyuan; Cui Yongqiang, all of Beijing, China

[73] Assignee: Institut of Engineering Thermophysics of Chinese Academy of Sciences, Beijing, China

[21] Appl. No.: 210,790

[22] Filed: Jun. 24, 1988

[30] Foreign Application Priority Data

Feb. 12, 1988 [CN] China ..... 88100682.3

[51] Int. Cl.[4] ..... F04D 29/44

[52] U.S. Cl. ..... 415/210.1; 415/199.3; 415/501; 416/DIG. 2

[58] Field of Search ..... 415/199.2, 199.3, 209, 415/210, 501; 416/186 R, DIG. 2

[56] References Cited

U.S. PATENT DOCUMENTS

| | | | |
|---|---|---|---|
| 1,629,141 | 5/1927 | Benson | 415/199.3 X |
| 2,641,191 | 6/1953 | Buchi | 415/199.2 X |
| 3,206,807 | 9/1965 | Hoffman et al. | 416/186 R X |
| 3,438,329 | 4/1969 | Fuller | 415/501 X |
| 3,776,664 | 12/1973 | Kimmel | 415/501 X |
| 4,564,334 | 1/1986 | Hergt et al. | 415/199.3 |
| 4,652,212 | 3/1987 | Burger et al. | 416/DIG. 2 |

FOREIGN PATENT DOCUMENTS

| | | | |
|---|---|---|---|
| 604121 | 6/1948 | United Kingdom | 415/210 |

*Primary Examiner*—Robert E. Garrett
*Assistant Examiner*—Joseph M. Pitko
*Attorney, Agent, or Firm*—Antonelli, Terry & Wands

[57] ABSTRACT

A multi-stage centrifugal pump mainly used for oil extraction, which includes two essential components, namely, a rotational impeller comprising several blades and a stationary diffuser. The shapes of blades and flow passages are designed by using three-dimensional flow theory. The configuration is characterized by the impeller length and the diffuser length being almost equal, with the moving blade being provided with an extension at the trailing edge, smaller wrap angle of the stationary diffuser blade, shorter single-stage and smaller outside diameter, and so forth.

11 Claims, 4 Drawing Sheets

OIL SUBMERSIBLE PUMP

BACKGROUND OF THE INVENTION

1. Field of the Invention

The present invention relates to an oil submersible pump.

In order to extract crude oil from non-flowing oil wells, special production equipment must be used. There are mainly two kinds of such equipments widely used at present: one is the piston-type oil extractor, the other is the oil submersible pump. Besides the use of extracting crude oil when submerged into oil wells, the oil submiersible pump can also be used for transferring water or other liquids.

2. Description of the Prior Art

The oil submersible pump applied in practice generally consists serially of multiple single-stage pumps with the same configuration. A typical single-stage pump is composed of two main parts namely, a rotable impeller and a stationary diffuser. The impeller is integrated by an impeller shroud as a collar rim, an impeller hub as a nave and circumferentialy equally spaced impeller blades therebetween. A driving motor rotates the impeller through a driving shaft to suck oil from an impeller inlet edge and discharge the suctioned oil through an impeller trailing edge, with the impeller being used for supercharging the fluid transferred. The diffuser is attached to the same shaft as the impeller on the impeller outlet side, being integrated by a diffuser shroud, a diffuser hub and equally spaced diffuser blades therebetween. The diffuser acts, firstly, to introduce the fluid out of the former stage impeller into the next impeller inlet and, secondly, to transform the kinetic energy of the fluid obtained from the impeller into static pressure energy.

The oil submersible pumps in prior techniques are mainly represented by type N-80 produced by Centrilife (Hughes) Company and type D-82 produced by Reda Pump Division (TRW) in the United States. The impeller blades and the diffuser blades of these conventional pumps are with the blade shape basically of the dimensional surface designed by using monadic flow theory, and the axial length of the impeller blade is much smaller than that of the nave, thus the relative velocity of the fluid at the impeller inlet being comparatively higher and the pressure gradient of the fluid in the impeller passages varying more intensively. The common disadvantages of these known pumps consist in lower hydraulic efficiency, lower head of a single stage, larger size of the contour, and so on.

SUMMARY OF THE INVENTION

The object of the present invention, against above-mentioned disadvantages of the known oil submersible pumps, lies in improving the hydraulic design of the impeller and diffuser of the oil submersible pumps to enhance the pump efficiency and the single-stage head, reduce the contour size of the pump, save electricity and lower production costs.

The object of the present invention is achieved by the following technical meassure: conducting hydraulic design for impeller blades and diffuser blades by using CAD programm with complete three-dimensional "Jet-Wake" flow calculation based on trinary flow theory to make the blade shape of these two kinds of blade be twisted three-dimensional ruled surface, lengthen impeller blades and shorten diffuser blades axially. When described in cylindrical coordinate system, the first type new blade shapes of impeller blades and the diffuser blades can be depicted by the line elements determined by the data in the following tables First Type Impeller Blade Shape

| | | | | | | | | | |
|---|---|---|---|---|---|---|---|---|---|
| $\phi/\phi_o$ | 0 | 0.0769 | 0.1539 | 0.3077 | 0.4615 | 0.6154 | 0.7692 | 0.8462 | 1.000 |
| $Z_s/\phi_R$ | — | 0.0000 | 0.3205 | 0.0769 | 0.1218 | 0.1667 | 0.1987 | 0.2115 | — |
| $R_s/\phi_R$ | — | 0.3333 | 0.3397 | 0.3654 | 0.3974 | 0.4359 | 0.4744 | 0.5000 | — |
| $Z_h/\phi_R$ | 0 | 0.0256 | 0.0577 | 0.1090 | 0.1603 | 0.2051 | 0.2500 | 0.2756 | 0.3205 |
| $R_h/\phi_R$ | 0.1795 | 0.1859 | 0.1987 | 0.2243 | 0.2564 | 0.2949 | 0.3462 | 0.3782 | 0.4359 |
| $\delta/\phi_R$ | 0.0128 | 0.0128 | 0.0167 | 0.0205 | 0.0231 | 0.0256 | 0.0256 | 0.0205 | 0.0205 |

where;

$\phi$ is an angular coordinate of a line element on the pressure surface of the impeller blade;

$\phi_o$ is a wrap angle of the impeller blade, $\phi_c = 50°-70°$, $\phi_o$ optimum $= 65°$;

$\phi_R$ is a outside diameter of the impeller, $\phi_R = 60-100$ mm, $\phi_R$ optimum $= 78$ mm;

$Z_s$ is a Z-axis coordinate in meridian plane of the intersection point made by the line element on the blade pressure surface and the collar rim internal surface of revolution $S_R$;

$R_s$ is a radial coordinate in the meridian plane of the intersection point made by the line element on the blade pressure surface and the collar rim internal surface of revolution $S_R$;

$Z_h$ is a Z-axis coordinate in meridian plane of the intersection point made by the line element on the blade pressure surface and the nave external surface of revolution $H_R$;

$R_h$ is a radial coordinate in meridian plane of the intersection point made by the line element on the blade pressure surface and the nave external surface of revolution H; and S is a blade thickness along the line element.

First Type Diffuser Blade Shape

| | | | | | | |
|---|---|---|---|---|---|---|
| $\phi/\phi_o$ | 0 | 0.2222 | 0.4444 | 0.6666 | 0.8888 | 1.0000 |
| $Z_s/\phi_R$ | 0 | 0.0449 | 0.0962 | 0.1538 | 0.2436 | 0.3397 |
| $D_s/\phi_R$ | 0.5128 | 0.5064 | 0.4936 | 0.4744 | 0.4231 | 0.3333 |
| $Z_h/\phi_R$ | 0 | 0.0385 | 0.0833 | 0.1218 | 0.1859 | 0.2436 |
| $D_h/\phi_R$ | 0.4205 | 0.4128 | 0.3974 | 0.3718 | 0.3013 | 0.2115 |
| $\delta/\phi_R$ | 0.0128 | 0.0192 | 0.0256 | 0.0320 | 0.0320 | 0.0256 |

where;

$\phi$ is an angular coordinate of a line element on the pressure surface of the diffuser blade;

$\phi_o$ is wrap angle of the diffuser blade, $\phi_o = 40°-60°$, $\phi_o$ optimum $= 45°$;

$\phi_R$ is an outside diameter of the first type impeller, $\phi_R = 60-10$ mm, $\phi_R$ optimum $= 78$ mm;

$Z_s$ is a Z-axis coordinate in meridian plane of the intersection point made by the line element on the blade pressure surface and the diffuser shroud internal surface of revolution $S_D$;

$D_s$ is a radial coordinate in meridian plane of the intersection made by the line element on the diffuser blade pressure surface and the diffuser shroud internal surface of revolution $S_D$;

$Z_h$ is a Z-axis coordinate in meridian plane of the intersection point made by the line element on the diffuser blade pressure surface and the diffuser hub external surface of revolution $H_D$;

$D_h$ is a radial coordinate in meridian plane of the intersection point made by the line element on the diffuser blade pressure surface and the diffuser hub external surface of revolution $H_D$; and S is a diffuser blade thickness along the line element.

| Second Type Impeller Blade Shape | | | | | | | | |
|---|---|---|---|---|---|---|---|---|
| $\phi/\phi_o$ | 0 | 0.1539 | 0.3077 | 0.4615 | 0.6154 | 0.7692 | 0.9231 | 1.0000 |
| $Z_v/\phi_R$ | 0 | 0.0385 | 0.0769 | 0.1154 | 0.1538 | 0.1923 | 0.2436 | 0.2692 |
| $R_v/\phi_R$ | 0.3461 | 0.3654 | 0.3846 | 0.4064 | 0.4359 | 0.4615 | 0.5000 | 0.5000 |
| $Z_h/\phi_R$ | 0 | 0.0385 | 0.0961 | 0.1667 | 0.2179 | 0.2756 | 0.3141 | 0.3333 |
| $R_h/\phi_R$ | 0.1667 | 0.1795 | 0.2051 | 0.2436 | 0.2846 | 0.3436 | 0.3910 | 0.4231 |
| $\delta/\phi_R$ | 0.0128 | 0.0154 | 0.0192 | 0.0237 | 0.0231 | 0.0231 | 0.0231 | 0.0192 |

where all designations are defined in the same manner as in the table for the first type impeller blade shape, except that $\phi_o$ is evaluated as $\phi_o = 50°-70°$, $\phi_{o\ optimum} = 65°$.

| Second Type Diffuser Blade shape | | | | | | | |
|---|---|---|---|---|---|---|---|
| $\phi/\phi_o$ | 0 | 0.2500 | 0.5000 | 0.7500 | 0.8125 | 0.8750 | 1.0000 |
| $Z_v/\phi_R$ | 0 | 0.0641 | 0.1410 | 0.2436 | 0.2756 | 0.3333 | — |
| $D_v/\phi_R$ | 0.5128 | 0.5090 | 0.4936 | 0.4513 | 0.4295 | 0.3974 | — |
| $Z_h/\phi_R$ | 0.0385 | 0.0769 | 0.1218 | 0.1795 | 0.1987 | 0.2244 | 0.3333 |
| $D_h/\phi_R$ | 0.3461 | 0.3397 | 0.3269 | 0.2962 | 0.2884 | 0.2692 | 0.1923 |
| $\delta/\phi_R$ | 0.0128 | 0.0154 | 0.0192 | 0.0231 | 0.0231 | 0.0231 | 0.0192 |

where all designations are defined in the same manner as in the table for the first type diffuser blade shape, except that $\phi_o$ is evaluated as $\phi_o = 30°-50°$, $\phi_{o\ optimum} = 40°$.

BRIEF DESCRIPTION OF THE DRAWINGS

The present invention will be described in detail as follows, while referring to the attached drawings.

DETAILED DESCRIPTION OF THE PREFERRED EMBODIMENT

Figure 1:
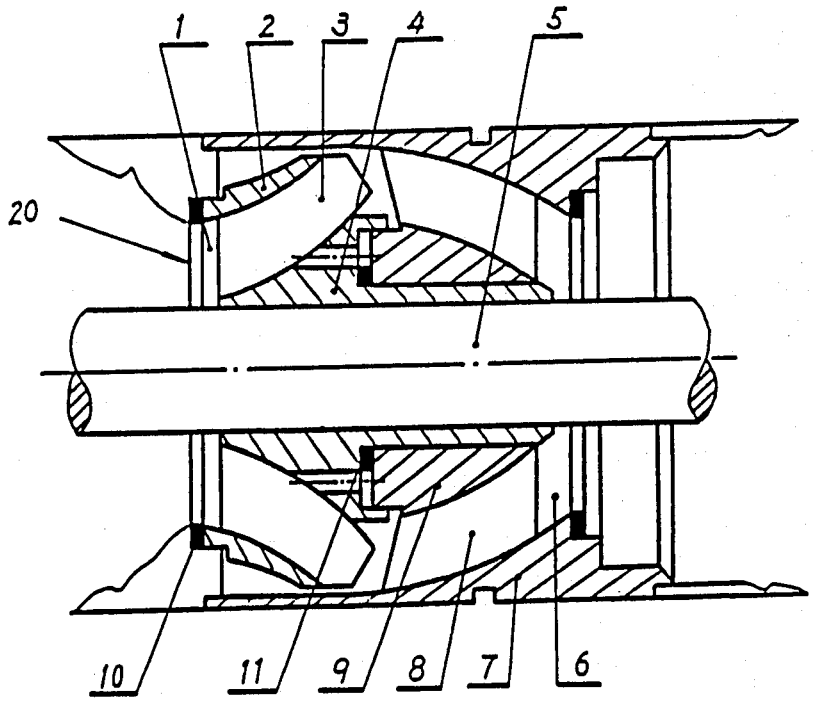
FIG. 1 is a cross-sectional view of an embodiment of the single-stage oil submersible pump in accordance with the present invention.

FIG. 1 illustrates an embodiment of the single-stage oil submersible pump in the present invention. The pump comprises impeller 1 and diffuser with the impeller 1 comprising an impeller shroud 2 as the collar rim, impeller hub 4 as the nave and several impeller blades 3 equally spaced within the annular space between impeller shroud 2 and impeller hub. The impeller shroud 2, impeller hub 4 and impeller blades 3 are integrated with each other. The central hole of impeller hub 4 is keyed to driving shaft 5, with the hub being driven by an electric motor (not shown). The annular space between impeller shroud 2 and impeller hub 4 is separated by the impeller blades 3 into multiple flow plassages. When an oil submersible pump operates, the fluid is sucked from the inlet into the passages and pushed from the trailing edge to the diffuser 6. Being a stationary component, the diffuser 6 comprises diffuser shroud 7, diffuser blades 8 and a diffuser hub 9. Diffuser blades 8 are equally spaced within the annular space between the diffuser shroud 7 and the diffuser hub 9, and integrated with the diffuser shroud (7) and diffuser hub 9. The annular space between the diffuser shroud 7 and the diffuser hub 9 is separated by the diffuser blades 8 into multiple flow passages, with the fluid from the impeller entering the next stage pump or discharging through these passages. Two effects of the diffuser blades 8 are: firstly, to introduce the fluid out of the former stage impeller to the next stage impeller inlet, and, secondly, to transform the kinetic energy of the fluid obtained from the impeller into static pressure energy. A front thrust gasket 10 and back thrust gasket 11 are provided between the impeller and the diffuser 6. It is possible to combine such single-stage pumps in series into a multi-stage pump.

In the present invention, the shapes of the impeller and diffuser blades 8 are designed based on trinary flow theory, thus being the optimum three-dimensional blade shapes with minimum flow loss. The impeller blade molded surface presents a three-dimentional ruled surface with its front portion intensively twisted, and the diffuser blade molded surface a twisted three-dimensional ruled surface.

Figure 5A:
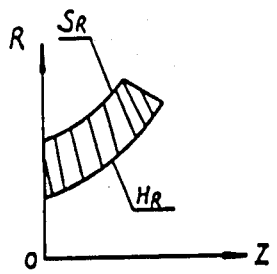
FIGS. 5*a*–5*b* are graphical illustrations in cylindrical coordinate system of the impeller and diffuser blades in the first embodiment of the present invention.
Figure 5C:
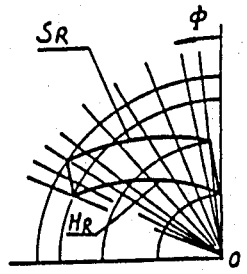
Figure 5B:
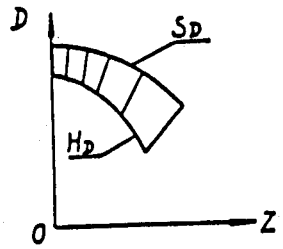

When the geometry of the impeller blade is described in cylindrical coordinate system with the central line of the shaft as Z axis and the following prescriptions are adopted:

a) the zero value of the impeller blade angular coordinate is taken on a radial line which passes the intersection point made by the impeller hub and the inlet edge of the blade molded surface;

b) anglular values are considered to be positive when taken against the rotational direction of the working impeller;

the geometry of the impeller blade of the first embodiment in the present invention, as shown in FIGS. 5*a* and 5*b*, can be determined by the line elements with coordinates given in the following table:

TABLE 1

| First Embodiment of the Impeller Blade | | | | | | | | | |
|---|---|---|---|---|---|---|---|---|---|
| $\phi/\phi_o$ | 0 | 0.0769 | 0.1539 | 0.3077 | 0.4615 | 0.6514 | 0.7692 | 0.8462 | 1.0000 |
| $Z_t/\phi_R$ | — | 0 | 0.03205 | 0.0769 | 0.1218 | 0.1667 | 0.1987 | 0.2115 | — |
| $R_t/\phi_R$ | — | 0.3333 | 0.3397 | 0.3654 | 0.3974 | 0.4359 | 0.4744 | 0.5000 | — |
| $Z_h/\phi_R$ | 0 | 0.0256 | 0.0577 | 0.1090 | 0.1603 | 0.2051 | 0.2500 | 0.2756 | 0.3205 |
| $R_h/\phi_R$ | 0.1795 | 0.1859 | 0.1987 | 0.2243 | 0.2564 | 0.2949 | 0.3462 | 0.3782 | 0.4359 |
| $\delta/\phi_R$ | 0.0128 | 0.0128 | 0.0167 | 0.0205 | 0.0231 | 0.0256 | 0.0256 | 0.0205 | 0.0205 |

where;

$\phi$ is an angular coordinate of a line element on the pressure surface of the impeller blade;

$\phi_o$ is a wrap angle of the impeller blade, $\phi_o = 50°-70°$;

$\phi_R$ is an outside diameter of the impeller, $\phi_R = 10$ mm;

$Z_t$ is a Z-axis coordinate in meridian plane of the intersection point made by the line element on the blade pressure surface and the collar rim surface of revolution $S_R$;

$R_t$ is a radial coordinate in meridian plane of the intersection point made by the line element on the blade pressure surface and the collar rim surface of revolution $S_R$;

$Z_h$ is a Z-axis coordinate in meridian plane of the intersection point made by the line element on the blade pressure surface and the nave surface of revolution $H_R$;

$R_h$ is a radial coordinate in meridian plane of the intersection point made by the line element on the blade pressure surface and the nave surface of revolution $H_R$; and $\delta$ is a blade thickness along the line element.

Figure 5D:
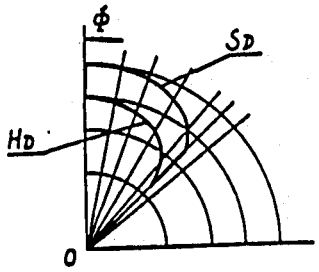
Figure 6A:
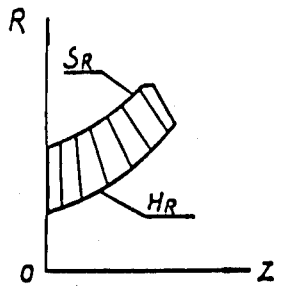
FIGS. 6*a*–6*b* are graphical illustrations in cylindrical coordinate system of the impeller and diffuser blades in the second embodiment of the present invention.
Figure 6C:
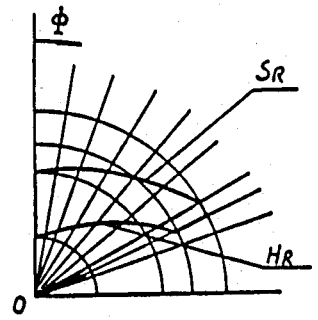
Figure 6B:
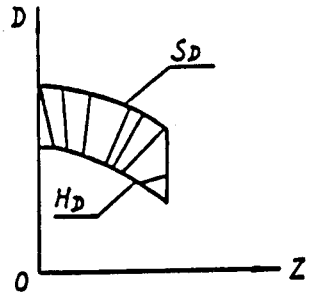
Figure 6D:
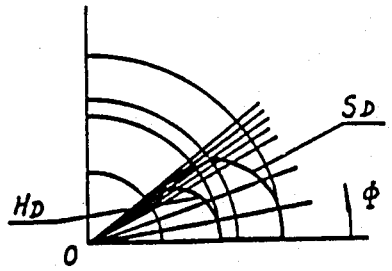

When the geometry of the diffuser blade is described in cylindrical coordinate system with the central line of the pump shaft as Z axis and the following prescriptions are adopted:

(a) the zero value of the diffuser blade angular coordinate is taken on a radial line which passes the intersection point made by the diffuster shroud internal surface of revolution and the inlet edge of the blade surface;

(b) angular values are considered to be positive when taken along the rotationl direction of the working impeller;

the geometry of the diffuser blade of the first embodiment of the present invention, as shown in FIGS. 5*c* and 5*d*, can be determined by the line elements with the coordinates given in the following table.

TABLE 2

| First Embodiment of the Diffuser Blade | | | | | | |
|---|---|---|---|---|---|---|
| $\phi/\phi_o$ | 0 | 0.2222 | 0.4444 | 0.6666 | 0.8888 | 1.0000 |
| $Z_t/\phi_R$ | 0 | 0.0449 | 0.0962 | 0.1538 | 0.2436 | 0.3397 |
| $D_t/\phi_R$ | 0.5128 | 0.5064 | 0.4936 | 0.4744 | 0.4231 | 0.3333 |
| $Z_h/\phi_R$ | 0 | 0.0385 | 0.0833 | 0.1218 | 0.1859 | 0.2436 |
| $D_h/\phi_R$ | 0.4205 | 0.4128 | 0.3974 | 0.3218 | 0.3013 | 0.2115 |
| $\delta/\phi_R$ | 0.0128 | 0.0192 | 0.0256 | 0.0320 | 0.0320 | 0.0256 |

where;

$\phi$ is an angular coordinate of the line element on the pressure surface of the diffuser blade;

$\phi_o$ is a wrap angle of the diffuser blade, $\phi_o = 40°-60°$;

$\phi_R$ is an outside diameter of the impeller in this embodiment, $\phi_R = 100$ mm;

$Z_t$ is a Z-axis coordinate in meridian plane of the intersection point made by the line element on the blade pressure surface and the diffuser shroud internal surface of revolution $S_D$;

$D_t$ is a radial coordinate in meridian plane of the intersection point made by the line element on the diffuser blade pressure surface and the diffuser shroud surface of revolution $S_D$;

$Z_h$ is a Z-axis coordinate in meridian plane of the intersection point made by the line element on the diffuser blade pressure surface and the diffuser hub external surface of revolution $H_D$;

$D_h$ is a radial coordinate in meridian plane of the intersection point made by the line element on the diffuser blade pressure surface and the diffuser hub external surface of revolution $H_D$; and $\delta$ is a diffuser blade thickness along the line element.

Figure 2A:
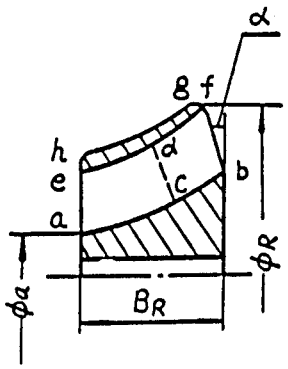
FIG. 2*a* is an axial cross-sectional view of the impeller blade in the present invention.
Figure 2B:
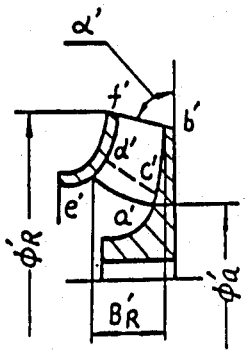
FIG. 2b. (PRIOR ART)
FIG. 2*b* is an axial cross-sectional view of a prior art impeller blade.

Referring to above description and FIGS. 2*a* and 2*b*, it can be seen that the impeller blade in the present invention has many features comparing to those in the prior art.

Firstly, the impeller blade in the present invention is a three-dimensional twisted-type blade with its front portion intensively twisted, the blade being designed by using CAD programm based on trinary "Jet--Wake" flow theory. Secondly, the axial length $B_R$ of the impeller blade has been greatly increased, the blade inlet edge being basically aligned with the inlet face of the nave and the blade trailing edge being at least extended to the outlet side of the nave external surface of revolution; that is, the axial length $B_R$ of the impeller at least equals to the axial length of the nave external surface of revolution. And it can be seen from FIG. 2*b* that the inlet edge of the impeller blade in the prior art starts at the middle of the nave, that is, its axial $B_R$ is shorter. Therefore, in the case of equal outside diameter of the impeller, the ratio of the impeller blade axial length $B_R$ to the impeller outside diameter $\phi_R$ ($B_R/\phi_R$) in the present invention is larger than the corresponding ratio ($B_R'/_R'$) in the prior art (FIG. 2*b*). In the present invention, the recommended $B_R/\phi_R = 0.3-0.4$, and in the prior art, the ratio $B_R'/O_R'$ is smaller than 0.3.

Because of the increase of the impeller axial length, the nave radius ($\phi_a$) at the impeller inlet in the present invention is smaller than the nave radius ($\phi_a'$) at the impeller inlet in the prior techniques, as shown in FIG. 2*a*.

Due to above features, the relative velocity at the impeller inlet has been decreased and the rising gradient of the fluid pressure within the impeller passages reduced, thus delaying or lessening the loss of the separated flow to make both the efficiency and the head of the pump raised.

The diffuser blade in the embodiment also has some unique features and advantages as compared with the diffuser blade in the prior techniques.

Figure 4A:
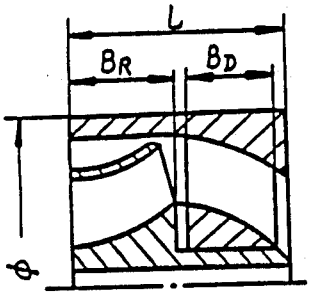
FIGS. 4*a* and 4*b* are cross-sectional views depicting the proportionality between the axial lengths of the conventional impeller and diffuser blades.
Figure 4B:
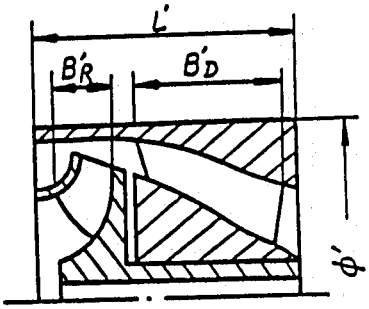

Firstly, the same as the impeller blade in the present invention, the diffuser blade in the present invention is also a three-dimensional twisted-type blade, which is designed by using CAD programm based on trinary "Jet–Wake" flow theory. Secondly, as shown in FIGS. 4*a* and 4*b*, the axial length of the diffuser blade in the present invention has been greatly reduced. This gets rid of the traditional design theory which holds: shortening the axial length of the guide blade of the former stage diffuser will worsen the flow at the next stage inlet to lead to reduction of the pump efficiency. However, when the three-dimensional twisted blade in the present invention adopted, shortening the axial dimension of the diffuser blade will not exert the harmful effects as predicted by the traditional theory. In the present invention, the ratio of the diffuser blade axial length to the impeller blade axial length ($B_D/B_R$)=0.8– 1.1, while in the prior techniques, this ratio is about 1.4–2.4. Since the axial length of the diffuser is greatly shortened, the total length of each single-stage pump can be reduced. It is quite clear that this is of great significance for the whole pump consisting of hundreds of such single-stage pumps.

In what follows we will introduce the second embodiment of the present invention. Similar to the first embodiment, the impeller and diffuser in the second embodiment also has some identical features: the twisted blade shape is of the type; the axial length of the impeller blade has been increased and the axial length of the diffuser blade decreased, and so on. What differs from the first embodiment is, the impeller blade in the second embodiment has been much more lengthened outwards on the outlet side.

Figure 3:
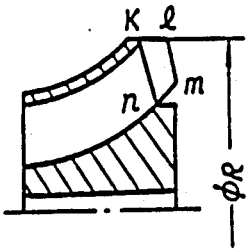
FIG. 3 is an axial cross-sectional view of an embodiment lengthening of the impeller blade trailing edge in accordance with the present invention.

The trailing edge of impeller blade 3 extends downstream in a manner that, (shown as FIG. 3) at the shroud 2, the edge is extended from the trailing point k to e along the line parallel to the pump axis; at the hub 4, from the trailing point n to m naturally along the molded line on the medidian plane; in order to assure the normal operation, the axial gap between segment lm and the diffuser blade inlet edge should not be smaller than the thickness of back thrust basket 11. Thus, in the case of unchanged impeller outside diameter and blade trailing angle, the blade surface area increases by klmn. This variation can effectively raise the pump head. In this embodiment, such an improvement may raise the head by 30%. It needs to be mentioned that this improvement also gets rid of the traditional design theory, which holds: in the case of specified rotation rate and inlet condition, the pump head only depends on the outside diameter of the impeller and the trailing angle of the impeller blade. The improvement in the present invention, however, verifies that the pump head can also be raised by increasing the length of the impeller blade trailing edge.

When described in the same manner as in the first embodiment, the geometry, as shown in FIGS. 6*a*–6*d*, of the impeller blade and the diffuser blade can be determined respectively by the following tables:

TABLE 3

| Second Embodiment of the Impeller Blade | | | | | | | | |
|---|---|---|---|---|---|---|---|---|
| $\phi/\phi_o$ | 0 | 0.1539 | 0.3077 | 0.4615 | 0.6154 | 0.7692 | 0.9231 | 1.0000 |
| $Z_v/\phi_R$ | 0 | 0.0385 | 0.0769 | 0.1154 | 0.1538 | 0.1923 | 0.2436 | 0.2692 |
| $R_v/\phi_R$ | 0.3461 | 0.3654 | 0.3846 | 0.4064 | 0.4359 | 0.4615 | 0.5000 | 0.5000 |
| $Z_h/\phi_R$ | 0 | 0.0385 | 0.0961 | 0.1667 | 0.2179 | 0.2756 | 0.3141 | 0.3333 |
| $R_h/\phi_R$ | 0.1667 | 0.1795 | 0.2051 | 0.2436 | 0.2846 | 0.3436 | 0.3910 | 0.4231 |
| $\delta/\phi_R$ | 0.0128 | 0.0154 | 0.0192 | 0.0231 | 0.0231 | 0.0231 | 0.0231 | 0.0192 |

where all the designation meanings and the evaluation ranges are the same as those in Table 1.

TABLE 4

| Second Embodiment of The Diffuser Blade | | | | | | | |
|---|---|---|---|---|---|---|---|
| $\phi/\phi_o$ | 0 | 0.2500 | 0.5000 | 0.7500 | 0.8125 | 0.8750 | 1.000 |
| $Z_v/\phi_R$ | 0 | 0.0641 | 0.1410 | 0.2436 | 0.2756 | 0.3333 | — |
| $D_v/\phi_R$ | 0.5128 | 0.5090 | 0.4936 | 0.4513 | 0.4295 | 0.3947 | — |
| $Z_h/\phi_R$ | 0.0385 | 0.0769 | 0.1218 | 0.1795 | 0.1987 | 0.2244 | 0.3333 |
| $D_h/\phi_R$ | 0.3461 | 0.3397 | 0.3269 | 0.2962 | 0.2884 | 0.2692 | 0.1923 |
| $\delta/\phi_R$ | 0.0128 | 0.0154 | 0.0192 | 0.0231 | 0.0231 | 0.0231 | 0.0192 |

where all the designation meanings are the same as those in Table 2, but the evaluation range of $\phi_o$ becomes $\phi_o$=30°–50°.

For the first embodiment, the optimum values of the impeller blade $\phi_o$=65°; $\phi_R$=75–85 mm, then Table 1 changes into Table 5:

TABLE 5

| $\phi$ | 0° | 5° | 10° | 20° | 30° | 40° | 50° | 55° | 65° |
|---|---|---|---|---|---|---|---|---|---|
| $Z_v/\phi_R$ | — | 0.0000 | 0.03205 | 0.0769 | 0.1218 | 0.1667 | 0.1987 | 0.2115 | — |
| $R_v/\phi_R$ | — | 0.3333 | 0.3397 | 0.3654 | 0.3974 | 0.4359 | 0.4744 | 0.5000 | — |
| $Z_h/\phi_R$ | 0.0000 | 0.0256 | 0.0577 | 0.1090 | 0.1603 | 0.2051 | 0.2500 | 0.2756 | 0.3205 |
| $R_h/\phi_R$ | 0.1795 | 0.1859 | 0.1987 | 0.2243 | 0.2564 | 0.2949 | 0.3462 | 0.3782 | 0.4359 |
| $\delta/\phi_R$ | 0.0128 | 0.0128 | 0.0167 | 0.0205 | 0.0231 | 0.0256 | 0.0256 | 0.0205 | 0.0205 |

The optimum values of the diffuser blade are $\phi_o$=45°; $\phi_R$=75–85 mm, then Table 2 changes into Table 6:

TABLE 6

| $\phi$ | 0° | 10° | 20° | 30° | 40° | 45° |
|---|---|---|---|---|---|---|
| $Z_v/\phi_R$ | 0.000 | 0.0449 | 0.0962 | 0.1538 | 0.2436 | 0.3397 |
| $R_v/\phi_R$ | 0.5128 | 0.5064 | 0.4936 | 0.4744 | 0.4231 | 0.3333 |
| $Z_h/\phi_R$ | 0.0000 | 0.0385 | 0.0833 | 0.1218 | 0.1859 | 0.2436 |
| $R_h/\phi_R$ | 0.4205 | 0.4128 | 0.3974 | 0.3718 | 0.3013 | 0.2115 |
| $\delta/\phi_R$ | 0.0128 | 0.0192 | 0.0256 | 0.0320 | 0.0320 | 0.0256 |

For the second embodiment, the optimum values of the impeller blade are $\phi_o$=65°; $\phi_R$=75–85 mm, then Table 3 changes into Table 7:

TABLE 7

| $\phi$ | 0° | 10° | 20° | 30° | 40° | 50° | 60° | 65° |
|---|---|---|---|---|---|---|---|---|
| $Z_s/\phi_R$ | 0.0000 | 0.0385 | 0.0769 | 0.1154 | 0.1538 | 0.1923 | 0.2436 | 0.2692 |
| $R_s/\phi_R$ | 0.3461 | 0.3654 | 0.3846 | 0.4064 | 0.4359 | 0.4615 | 0.5000 | 0.5000 |
| $Z_h/\phi_R$ | 0.0000 | 0.0385 | 0.0961 | 0.1667 | 0.2179 | 0.2756 | 0.3141 | 0.3333 |
| $R_h/\phi_R$ | 0.1667 | 0.1795 | 0.2051 | 0.2436 | 0.2846 | 0.3436 | 0.3910 | 0.4231 |
| $\delta/\phi_R$ | 0.0128 | 0.0154 | 0.0192 | 0.0231 | 0.0231 | 0.0231 | 0.0231 | 0.0192 |

The optimum values of the diffuser blade are $\phi_o=40°$; $\phi_R=75$–85 mm, then Table 4 changes into Table 8:

TABLE 8

| $\phi$ | 0° | 10° | 20° | 30° | 32.5° | 35° | 40° |
|---|---|---|---|---|---|---|---|
| $Z_s/\phi_R$ | 0.0000 | 0.0641 | 0.1410 | 0.2436 | 0.2756 | 0.3333 | — |
| $D_s/\phi_R$ | 0.5128 | 0.5090 | 0.4936 | 0.4513 | 0.4295 | 0.3974 | — |
| $Z_h/\phi_R$ | 0.0385 | 0.0769 | 0.1218 | 0.1795 | 0.1987 | 0.2244 | 0.3333 |
| $D_h/\phi_R$ | 0.3461 | 0.3397 | 0.3269 | 0.2962 | 0.2884 | 0.2692 | 0.1923 |
| $\delta/\phi_R$ | 0.0128 | 0.0154 | 0.0192 | 0.0231 | 0.0231 | 0.0231 | 0.0192 |

The specifications of a real product manufactured according to the first embodiment of the present invention are as follows:

Outside diameter of the impeller . . . $\phi_R=78$ mm;

Outside diameter of the diffuser shroud . . . $\phi_D=85$ mm;

Axial length of the impeller blade $B_R=25$ mm;

Ratio of the impeller blade axial length to the impeller outside diameter . . . $B_R/\phi_R=0.32$;

Number of the impeller blades . . . $Z_R=6$;

Wrap angle of the impeller blade . . . 65°;

Axial length of diffuser blade . . . $B_D=26.5$ mm,

Ratio of the diffuser blade axial length to the impeller blade axial length . . . $B_D/B_R=1.06$;

Number of the diffuser blades . . . $Z_D=7$;

Wrap angle of the diffuser blade . . . $\phi_o=45°$; and

Length of a single-stage pump . . . =58 mm.

Compared with the products of the same kind in the prior art, the efficiencyof this pump has been increased by more than 5% and single stage head raised by 10% when the capacity being the same. The pump is suitable for oil. or water wells with 5" casings, the recommended capacity ranges from 250 to 380 cubic meters per day and the optimum efficiency capacity is 300 cubic meters per day. The coordinates of the molded lines of the impeller and diffuser blades are in Table 9 and Table 10.

TABLE 9

| $\phi$ | 0° | 5° | 10° | 20° | 30° | 40° | 50° | 55° | 65° |
|---|---|---|---|---|---|---|---|---|---|
| $Z_s$ | — | 0.0 | 2.5 | 6 | 9.5 | 13 | 15.5 | 16.5 | — |
| $R_s$ | — | 26 | 26.5 | 28.5 | 31 | 34 | 37 | 39 | — |
| $Z_h$ | 0.0 | 2.0 | 4.5 | 8.5 | 12.5 | 16 | 19.5 | 21.5 | 25 |
| $R_h$ | 14 | 14.5 | 15.5 | 17.5 | 20 | 23 | 27 | 29.5 | 34 |
| $\delta$ | 1.0 | 1.0 | 1.3 | 1.6 | 1.8 | 2.0 | 2.0 | 1.6 | 1.6 |

TABLE 10

| $\phi$ | 0° | 10° | 20° | 30° | 40° | 45° |
|---|---|---|---|---|---|---|
| $Z_s$ | 0 | 3.5 | 7.5 | 12 | 19 | 26.5 |
| $D_s$ | 40 | 39.5 | 38.5 | 37 | 33 | 26 |
| $Z_h$ | 0 | 3 | 6.5 | 9.5 | 14.5 | 19 |
| $D_h$ | 32.8 | 32.2 | 31 | 29 | 23.5 | 16.5 |
| $\delta$ | 1.0 | 1.5 | 2.0 | 2.5 | 2.5 | 2.0 |

The specifications of a real product manufactured according to the second embodiment of the prsent invention are as follows:

Outside diameter of the impeller . . . $\phi_R=78$ mm;

Outside diameter of the diffuser shroud . . . $\phi_D=85$ mm;

Axial length of the impeller blade . . . $B_R=26$ mm;

Ratio of the impeller blade axial length to the impeller outside diameter . . . $B_R/\phi_R=0.3333$;

Extended segments of the trailing edge of the impeller blade kn=3 mm; 1 m=6 mm;

Number of the impeller blades . . . $Z_R=5$;

Wrap angle of the impeller blade . . . $\phi_o=65°$;

Axial length of the diffuser blade . . . $B_D=26$ mm;

Ratio of the diffuser blade axial length to the impeller blade axial length $B_D/B_R=1$;

Number of the diffuser blades . . . $Z_D=7$;

Wrap angle of the diffuser blade . . . $\phi_c=40°$; and

Length of a single-stage pump . . . =65 mm.

The coordinates of the molded lines of the impeller and diffuser blades are in Table 11 and Table 12.

TABLE 11

| $\phi$ | 0° | 10° | 20° | 30° | 40° | 50° | 60° | 65° |
|---|---|---|---|---|---|---|---|---|
| $Z_s$ | 0 | 3 | 6 | 9 | 12 | 15 | 19 | 21 |
| $R_s$ | 27 | 28.5 | 30 | 31.7 | 34 | 36 | 39 | 39 |
| $Z_h$ | 0 | 3 | 7.5 | 13 | 17 | 21.5 | 24 | 26 |
| $R_h$ | 13 | 14 | 16 | 19 | 22.2 | 26.8 | 30.5 | 33 |
| $\delta$ | 1.0 | 1.2 | 1.5 | 1.8 | 1.8 | 1.8 | 1.8 | 1.5 |

TABLE 12

| $\phi$ | 0° | 10° | 20° | 30° | 32.5° | 35° | 40° |
|---|---|---|---|---|---|---|---|
| $Z_s$ | 0 | 5 | 11 | 19 | 21.5 | 26 | — |
| $D_s$ | 40 | 39.7 | 38.5 | 35.2 | 33.5 | 31 | — |
| $Z_h$ | 3 | 6 | 9.5 | 14 | 15.5 | 17.5 | 26 |
| $D_h$ | 27 | 26.5 | 25.5 | 23.1 | 22.5 | 21 | 15 |
| $\delta$ | 1.0 | 1.2 | 1.5 | 1.8 | 1.8 | 1.5 | 1.5 |

Compared with the products of the same kind in the prior art, the efficiency of this pump has been increased by more than 5% and the pump head raised by 30% when the capacity being the same. The pump is suitable for oil or water wells with 4" casings, the recommended capacity ranges from 350 to 650 cubic meters per day and the the optimum efficiency capacity is 530 cubic meters per day.

The present invention and its embodiments have been described in detail as stated above. It should be understood that although the technicians in this field may make some revisions to the configuration and features of the present invention, the protection scope defined by the claims of the present invention still can not be gone beyond.

We claim:

1. An oil submersible pump comprising at least one stage pump serially wherein each stage pump comprises a rotatable impeller and a stationary diffuser coaxially arranged on an outlet side of the impeller; the impeller comprising an annular impeller shroud as a collar rim, an impeller hub as a nave coaxial with the impeller shroud, and a plurality of circumferentially equally spaced impeller blades between the impeller shroud and the impeller hub and integrated with said imcentral hole of the impeller hub, a cxentral hole of the impeller hub being attached to a driving shaft of a power means; the diffuser comprising a diffuser shroud, a diffuser hub coaxial with the diffuser shroud, and a plurality of circumferentially equally spaced diffuser blades between the diffuser shroud and the diffuser hub and integrated with said diffuser shroud and said diffuser hub; flow passages being formed by spaces determined by the impeller shroud, the impeller hub and the impeller blades, as well as the diffuser shroud, the diffthe diffuser blades, respectively; a molded surface of the impeller is a three-dimensional twisted ruled surface with a portion thereof adjacent to an inlet side of said impeller being twisted with the ruled surface of the impeller blade being non-parallel to an axis of the driving shaft, and a molded surface of the diffuser blade is a twisted three-dimensional ruled surface with the ruled surface of the diffuser blade being non-parallel to the axis of the driving shaft.

2. The oil submersible pump accoimpeller blade is described in a cylindrical coordinate system with a central line of the pump shaft as a Z-axis and the following prescriptions are adopted:

a) a zero value of the impeller blade angular coordinate is taken on a radial line which passes a intersection point made by the impeller hub and the trailing edge of the blade molder surface;

b) angular values are considered to be positive when taken against a rotational direction of a working impeller;

geometry of the impeller blathe line elements with the coordinates given in the following table:

| $\phi/\phi_o$ | 0.0000 | 0.0769 | 0.1539 | 0.3077 | 0.4615 | 0.6154 | 0.7692 | 0.8462 | 1.0000 |
|---|---|---|---|---|---|---|---|---|---|
| $Z_s/\phi_R$ | — | 0.0000 | 0.03205 | 0.0769 | 0.1218 | 0.1667 | 0.1987 | 0.2115 | — |
| $R_s/\phi_n$ | — | 0.3333 | 0.3397 | 0.3654 | 0.3974 | 0.4359 | 0.4744 | 0.5000 | — |
| $Z_h/\phi_R$ | 0.0000 | 0.0256 | 0.0577 | 0.1090 | 0.1603 | 0.2051 | 0.2500 | 0.2756 | 0.3205 |
| $R_h/\phi_R$ | 0.1795 | 0.1859 | 0.1987 | 0.2243 | 0.2564 | 0.2949 | 0.3462 | 0.3782 | 0.4359 |
| $\delta/\phi_R$ | 0.0128 | 0.0128 | 0.0167 | 0.0205 | 0.0231 | 0.0256 | 0.0205 | 0.0205 | 0.0205 |

where:

$\phi$ is an angular coordinate of a line element on a pressure surface of the impeller blade;

$\phi_0$ is a wrap angle of the impeller blade, $\phi_0=50°-70°$;

$\phi_R$ is an outside diameter of the impeller, $\phi_R=60-100$ mm;

$Z_s$ is a Z-axis coordinate in a meridian plane of an intersection point made by a line element on a blade pressure surface and an intersection line $S_R$made by a collar rim surface of revolution and the blade pressure surface. mm;

$R_s$ is a radial coordinate in a meridian plane of the an intersection point made by a line element on the blade pressure surface and the intersection line $S_R$ made by the collar rim surface of revolution and the blade pressure surface, mm;

$Z_h$ is a Z-axis coordinate in a meridian plane of an intersection point made by a line element on the blade pressure surface and the intersection line $H_R$ made by a nave surface of revolution and the blade pressure surface, mm;

$R_h$ is a radial coordinate in a meridiani plane of an intersection point made by a line element on the blade pressure surface and the intersection line $H_R$ made by the nave surface of revolution and the blade pressure surface, mm; and $\sigma$ is a blade thickness along the line element, mm.

3. The oil submersible pump according to claim 2. wherein when the wrap angle of the impeller blade is 65° and the outside diameter of the impeller $\phi_R$ is 75–85 mm, the coordinates of the line elements determining the geometry of the impeller blade are in the following table:

| $\phi$ | 0 | 5° | 10° | 20° | 30° | 40° | 50° | 55° | 65° |
|---|---|---|---|---|---|---|---|---|---|
| $Z_s/\phi_R$ | — | 0.0000 | 0.03205 | 0.0769 | 0.1218 | 0.1667 | 0.1987 | 0.2115 | — |
| $R_s/\phi_R$ | — | 0.3333 | 0.3397 | 0.3654 | 0.3974 | 0.4359 | 0.4744 | 0.5000 | — |
| $Z_h/\phi_R$ | 0.0000 | 0.0256 | 0.0577 | 0.1090 | 0.1603 | 0.2051 | 0.2500 | 0.2756 | 0.3205 |
| $R_h/\phi_R$ | 0.1795 | 0.1859 | 0.1987 | 0.2243 | 0.2564 | 0.2949 | 0.3462 | 0.3782 | 0.4359 |
| $\delta/\phi_R$ | 0.0128 | 0.0128 | 0.0167 | 0.0205 | 0.0231 | 0.0256 | 0.0205 | 0.0205 | 0.0205 |

4. The oil submersible pump according to claim 1. wherein when the geometry of the diffuser blade as described in a cylindrical coordinate system with a central line of the pump shaft as the Z-axis and the following prescriptions are adopted:

a) a zero value of a diffuser blade angular coordinate is taken along a radial line which passes an intersection point made by a diffuser shroud internal surface of revolution and an inlet edge of the blade surface;

b) angular values are considered to be positive when taken along a rotational direction of a working impeller;

a geometry of the diffuser blade can be determined by the elements with the coordinates given in the following table:

| $\phi/\phi_o$ | 0.0000 | 0.2222 | 0.4444 | 0.6666 | 0.8888 | 1.0000 |
|---|---|---|---|---|---|---|
| $Z_s/\phi_R$ | 0.0000 | 0.0449 | 0.0962 | 0.1538 | 0.2436 | 0.3397 |
| $D_s/\phi_R$ | 0.5128 | 0.5064 | 0.4936 | 0.4744 | 0.4231 | 0.3333 |
| $Z_h/\phi_R$ | 0.0000 | 0.0385 | 0.0833 | 0.1218 | 0.1859 | 0.2436 |
| $D_h/\phi_R$ | 0.4205 | 0.4128 | 0.3974 | 0.3718 | 0.3013 | 0.2115 |
| $\delta/\phi_R$ | 0.0128 | 0.0192 | 0.0256 | 0.0320 | 0.0320 | 0.0256 |

where:

$\phi$ is an angular coordinate of a line element on a pressure surface of the diffuser blade;

$\phi_O$ is a wrap angle of the diffuser blade, $\phi_O = 40°-60°$;

$\phi_R$ is an outside diameter of the impeller, $\phi_R = 60-100$ mm;

$Z_S$ is a Z-axis coordinate in a meridian plate of an intersection point made by a line element on the blade pressure surface and intersection line $S_D$ made by a diffuser shroud internal surface of revolution and the diffuser blade pressure surface, mm;

$D_s$ is a radial coordinate in a meridian plane of an intersection point made by a line element on the diffuser blade pressure surface and an intersection line $S_D$ made by the diffuser shroud surface of revolution and the diffuser blade pressure surface, mm;

$Z_h$ is a Z-axis coordinate in a meridian plane of an intersectdiffuser blade pressure surface and an intersection line $H_D$ made by a diffuser hub external surface of revolution and the diffuser blade pressure surface, mm;

$D_h$ is a radial coordinate in a meridian plane of an intersection point made by a line element on the diffuser blade pressure surface and the intersection line $H_D$ made by the diffuser hub external surface of revolution and the diffuser blade pressure surface, mm; and $\sigma$ is a diffuser blade thickness along the line element, mm.

5. The oil submersible pump according to claim 4, wherein when the wrap angle of the diffuser blade $\phi_o$ is 45° and the outside diameter of the impeller $\phi_R$ is 75–85 mm, the coordinates of the line elements determining the geometry of the diffuser blade are in the following table:

| $\phi$ | 0° | 10° | 20° | 30° | 40° | 45° |
|---|---|---|---|---|---|---|
| $Z_s/\phi_R$ | 0.0000 | 0.0449 | 0.0962 | 0.1538 | 0.2436 | 0.3397 |
| $D_s/\phi_R$ | 0.5128 | 0.5064 | 0.4936 | 0.4744 | 0.4231 | 0.3333 |
| $Z_h/\phi_R$ | 0.0000 | 0.0385 | 0.0833 | 0.1218 | 0.1859 | 0.2436 |
| $D_h/\phi_R$ | 0.4205 | 0.4128 | 0.3974 | 0.3718 | 0.3013 | 0.2115 |
| $\delta/\phi_R$ | 0.0128 | 0.0192 | 0.0256 | 0.0320 | 0.0320 | 0.0320 |

6. The oil submersible pump according to claim 1, wherein when the geometry of the impeller blade is described in a cylindrical coordinate system with a central line of the pump shaft as the Z-axis and the following prescriptions are adopted:

(a) a zero value of the impeller blade angular coordinate is taken on a radial line which passes an intersection point made by the impeller hub and a trailing edge of the blade molded surface;

(b) angular values are considered to be positive when taken against a rotational direction of a working impeller;

a geometry of the impeller blade can be determined by the line elements with the coordinates given in the following table:

| $\phi/\phi_o$ | 0.0000 | 0.1539 | 0.3077 | 0.4615 | 0.6154 | 0.7692 | 0.9231 | 1.0000 |
|---|---|---|---|---|---|---|---|---|
| $Z_s/\phi_R$ | 0.0000 | 0.0385 | 0.0769 | 0.1154 | 0.1538 | 0.1923 | 0.2436 | 0.2692 |
| $R_s/\phi_R$ | 0.3461 | 0.3654 | 0.3848 | 0.4064 | 0.4359 | 0.4615 | 0.5000 | 0.5000 |
| $Z_h/\phi_R$ | 0.0000 | 0.0385 | 0.0961 | 0.1667 | 0.2179 | 0.2756 | 0.3141 | 0.3333 |
| $R_h/\phi_R$ | 0.1667 | 0.1795 | 0.2051 | 0.2436 | 0.2848 | 0.3436 | 0.3910 | 0.4231 |
| $\delta/\phi_R$ | 0.0128 | 0.0154 | 0.0192 | 0.0231 | 0.0231 | 0.0231 | 0.0231 | 0.0192 |

wherein:

$\phi$ is an angular coordinate of a line element on a pressure surface of the impeller blade;

0 is a wrap angle of the impeller blade, $0 = \phi 0°-70°$;

$\phi R$ is an outside diameter of the impeller, $\phi R = 60-100$ mm;

$Z_x$ is a Z-axis coordinate in a meridian plane of an intersection point made by a line element on a blade pressure surface and an intersection line $S_R$ made by a collar rim surface of revolution and the blade pressure surface, mm;

$R_s$ is a radial coordinate in a meridian plane of an intersection point made by a line element on the blade pressure surface and the intersection line $S_R$ made by the collar rim surface of revolution and the blade pressure surface, mm;

$Z_h$ is a Z-axis coordinate in a meridian plane of an intersection point made by a line element on the blade pressure surface and the intersection line $H_R$ made by a nave surface of revolution and the blade pressure surface, mm;

$R_h$ is a radial coordinate in a meridian plane of an intersection point made by a line element on the blade pressure surface and the intersection line $H_R$ made by the nave surface of revolution and the blade pressure surface, mm; and $\sigma$ is a blade thickness along the line element, mm.

7. The oil submersible pump according to claim 6, wherein when the wrap angle of the impeller blade $\phi_0$ is 65° and the outside diameter of the impeller $\phi_R$ is 75°–80° mm; the coordinates of the line elements determining the geometry of the impeller blade are in the following table:

| $\phi$ | 0° | 10° | 20° | 30° | 40° | 50° | 60° | 65° |
|---|---|---|---|---|---|---|---|---|
| $Z_s/\phi_R$ | 0.0000 | 0.0385 | 0.0769 | 0.1154 | 0.1538 | 0.1923 | 0.2436 | 0.2692 |
| $R_s/\phi_R$ | 0.3461 | 0.3654 | 0.3846 | 0.4064 | 0.4359 | 0.4615 | 0.5000 | 0.5000 |
| $Z_h/\phi_R$ | 0.0000 | 0.0385 | 0.0961 | 0.1667 | 0.2179 | 0.2756 | 0.3141 | 0.3333 |
| $R_h/\phi_R$ | 0.1667 | 0.1795 | 0.2051 | 0.2436 | 0.2846 | 0.3436 | 0.3910 | 0.4231 |
| $\delta/\phi_R$ | 0.0128 | 0.0154 | 0.0192 | 0.0231 | 0.0231 | 0.0231 | 0.0231 | 0.0192 |

8. The oil submersible pump according to claim 1, wherein when the geometry of the diffuser blade is described in a cylindrical coordinate system with a central line of the pump shaft as the Z-axis and the following prescriptions are adopted:

(a) a zero value of the diffuser blade angular coordinate is taken on a radial line which passes an intersection point made by a diffuser shroud internal surface of revolution and an inlet edge of the blade surface;

(b) angular values are considered to be positive when taken along a rotational direction of a working impeller;

a geometry of the diffuser blade can be determined by the line elements with the coordinates given in the following table:

| $\phi/\phi_0$ | 0.0000 | 0.2500 | 0.5000 | 0.7500 | 0.8125 | 0.8750 | 1.0000 |
|---|---|---|---|---|---|---|---|
| $Z_s/\phi_R$ | 0.0000 | 0.0641 | 0.1410 | 0.2436 | 0.2756 | 0.3333 | — |
| $D_s/\phi_R$ | 0.5128 | 0.5090 | 0.4936 | 0.4513 | 0.4295 | 0.3974 | — |
| $Z_h/\phi_R$ | 0.0385 | 0.0769 | 0.1218 | 0.1795 | 0.1987 | 0.2244 | 0.3333 |
| $D_h/\phi_R$ | 0.3461 | 0.3397 | 0.3269 | 0.2962 | 0.2884 | 0.2692 | 0.1923 |
| $\delta/\phi_R$ | 0.0128 | 0.0154 | 0.0192 | 0.0231 | 0.0231 | 0.0231 | 0.0192 |

where:

$\phi$ are angular coordinates of a line element on a pressure surface of the diffuser blade;

$\phi 0$ is a wrap angle of the diffuser blade, $\phi_0=30°-50°$;

$\phi R$ is an outside diameter of the impeller, $\phi_R=60-100$ mm;

$Z_s$ is a Z-axis coordinate in a meridian plane of an intersection point made by a line element on the blade pressure surface and intersection line $S_D$ made by the diffuser shroud surface of revolution and the diffuser blade pressure surface, mm;

$D_s$ is a radial coordinate in a meridian plane of an intersection point made by a line element on the diffuser blade pressure surface and the intersection line $S_D$ made by the diffuser shroud surface of revolution and the diffuser blade pressure surface, mm;

$Z_h$ is a Z-axis coordinate in a meridian plane of an intersection point made by a line element on the diffuser blade pressure surface and the intersection line $H_D$ made by the diffuser hub surface of revolution and the diffuser blade pressure surface, mm;

$D_h$ is a radial coordinate in a meridian plane of an intersection point made by the diffuser hub surface of revolution and the diffuser blade pressure surface, mm; and $\sigma$ is a diffuser blade thickness along the line element, mm.

9. The oil submiersible pump according to claim 8, wherein when the wrap angle of the diffuser blade $\phi_0=40°$ and the outside diameter of the impeller $\phi_R=75-85$ mm, the coordinates of the line elements determining the geometry of the diffuser blade are in the following table:

| $\phi$ | 0° | 10° | 20° | 30° | 32.5° | 35° | 40° |
|---|---|---|---|---|---|---|---|
| $Z_s/\phi_R$ | 0.0000 | 0.0641 | 0.1410 | 0.2436 | 0.2756 | 0.3333 | — |
| $D_s/\phi_R$ | 0.5128 | 0.5090 | 0.4936 | 0.4513 | 0.4295 | 0.3974 | — |
| $Z_h/\phi_R$ | 0.0385 | 0.0769 | 0.1218 | 0.1795 | 0.1987 | 0.2244 | 0.3333 |
| $D_h/\phi_R$ | 0.3461 | 0.3397 | 0.3269 | 0.2962 | 0.2884 | 0.2692 | 0.1923 |
| $\delta/\phi_R$ | 0.0128 | 0.0154 | 0.0192 | 0.0231 | 0.0231 | 0.0231 | 0.0192 |

10. The oil submersible pump according to claim 1, wherein a ratio of said diffuser blade axial length $B_D$ to said impeller blade axial length $B_R$ is 0.8–1.1.

11. The oil submersible pump according to claim 1, wherein a ratio of said impeller blade axial length $B_R$ to said impeller outside diameter $\phi_R$ is 0.3–0.4.

* * * * *